United States Patent [19]

Kageyama et al.

[11] 4,011,417

[45] Mar. 8, 1977

[54] DYNAMIC TYPE PICKUP

[75] Inventors: Tomo Kageyama, Sakai; Yakichi Yoshinuma, Numazu, both of Japan

[73] Assignee: Messrs. Kabushiki Kaisha Mitachi Onkyo Seisakusho, Japan

[22] Filed: Mar. 17, 1975

[21] Appl. No.: 558,656

[30] Foreign Application Priority Data

Mar. 19, 1974 Japan ..... 49-3058

[52] U.S. Cl. ..... 179/100.41 K; 179/100.41 Z; 179/100.41 D; 274/37

[51] Int. Cl.[2] ..... H04R 11/12

[58] Field of Search ..... 179/100.41 Z, 100.41 K, 179/100.41 M, 100.41 D, 100.41 R; 274/37

[56] References Cited

UNITED STATES PATENTS

| | | | |
|---|---|---|---|
| 3,043,920 | 7/1962 | McConnell | 179/100.41 M |
| 3,230,318 | 1/1966 | Engel | 179/100.41 K |
| 3,294,405 | 12/1966 | Pritchard | 179/100.41 K |
| 3,761,647 | 9/1973 | Nemoto | 179/100.41 K |

FOREIGN PATENTS OR APPLICATIONS

| | | | |
|---|---|---|---|
| 1,000,035 | 8/1965 | United Kingdom | 179/100.41 K |

*Primary Examiner*—Daryl W. Cook
*Assistant Examiner*—Alan Faber
*Attorney, Agent, or Firm*—McGlew and Tuttle

[57] ABSTRACT

A record pickup is comprised of a magnetic yoke with parallel first and second leg portions. The first leg portion supports a coil. The second leg portion has a bore which resiliently supports a conductive bar opposite the coil. The conductive bar is attached to a stylus. Thus, movement of the stylus in a record groove produces a corresponding current in the coil.

3 Claims, 6 Drawing Figures

DYNAMIC TYPE PICKUP

SUMMARY OF THE INVENTION

This invention relates to a dynamic type pickup and more particularly to a dynamic type pickup for disc record characterized in that a relatively slight gap is provided between a stationary coil portion and an electric conductive piece fixed to a cantilever of stylus or needle assembly, the distance of said slight gap being changed to move a magnetic flux thereby to generate an acoustic current in conformity to the dynamic type principle by cutting the magnetic flux basing upon the actuation of the coil portion.

And, this invention also provides the dynamic type pickup wherein a coil portion is composed of spiraling of each coil in which two coils are provided in the inclination of 45° to the horizontal plane of a coil frame and crossed at a right angle to each other, and an electric conductive piece is vibrated in parallel with one coil of the coil portion and to the perpendicular direction to other coil thereof thereby to generate an acoustic current to any one of coils.

Further, this invention provides the dynamic type pickup in which a coil portion is removably fixed to a fitting portion of a yoke through a magnetic shield inserted at the grooved periphery of said fitting thereby to increase the fitting degree without disarranged fitting.

Heretofore, the dynamic type pickup has been proposed as a moving coil type pickup in which a coil is moved in the magnetic field without providing a stationary coil or coil portion and, in practice, it has been used the movement of coil or coil portion in order to move the conductor but there were some disadvantages of considerably troublesome matter and of high price to make a good pickup in limitations of the treatment of outgoing line and of high frequency basing on much mass of coil. This invention, in order to overcome the disadvantages, proposes a new type pickup in which the dynamic type power generation is accomplished cutting a magnetic flux by a use of an electric conductor basing on the movement of the magnetic flux to a stationary coil or coil portion.

Generally, it is said that, in a dynamic generating principle, an electric current is originated cutting the magnetic flux by a use of the electric conductor and, when the movement of the electric conductor is equal to the wave form of sound cut in grooves of disc record, the current flowing in the electric conductor also equals to the wave form of sound and this invention has adopted in practice the dynamic generating principle, thus, according to this invention, it is expected that the current equaling to the wave form of sound is originated by cutting the magnetic flux basing on the stationary coil conductor.

Therefore, an object of this invention is to provide the dynamic type pickup in which the user can be rerecorded extremely exact original sound from the record without occurrences of any deformations or deflections.

Another object of this invention is to provide the dynamic type pickup in which the coil or coil portion has been fixed to the end of yoke thereby to provide no necessity of care about the treatment of outgoing line.

A further object of this invention is to provide the dynamic type pickup in which the tip of the movable portion acts to transmit or trunk the magnetic force through the bar or pipe made of light soft iron to the direction to be circulated thereby to exchange effectively the movable portion only in case where said tip has been worn.

A still object of this invention is to provide the dynamic type pickup in which there is no power generation without any affection to other coil in case where one coil is generated thereby to avoid the occurrence of cross-stroke based on left and right channels. An additional object of this invention is to provide the dynamic type pickup in which the coil portion is removably fixed to a fitting portion through a magnetic shield inserted at the periphery of said fitting thereby to avoid a difficulty of fitting of coil portion to a yoke and an occurrence of disarranged fitting in conformity with the height of laminated coil layer.

Other and further objects, features and advantages of this invention will appear more fully from the following description with reference to the accompanying drawings.

Figure 1:
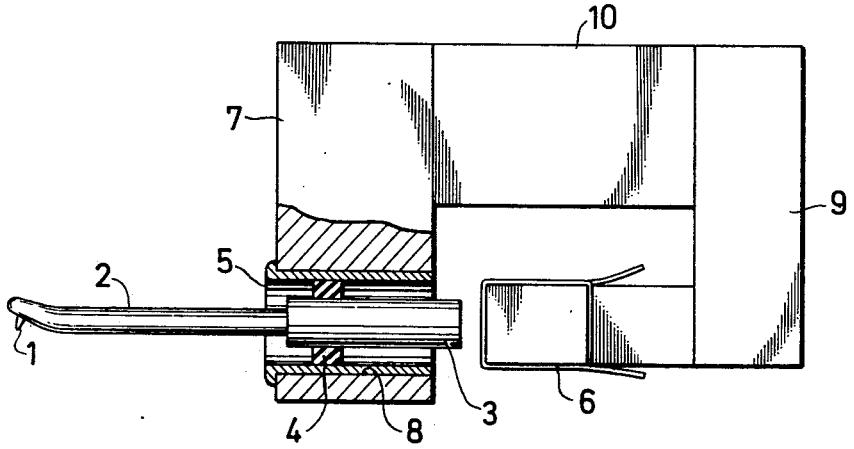
FIG. 1 is a side sectional view of the first embodiment according to this invention.

The first embodiment of this invention is described with reference to FIGS. 1 and 2 below.

DESCRIPTION OF THE PREFERRED EMBODIMENTS

The reference numeral 1 indicates a tip, such as a jewel stylus, passing in a sound groove of record, the numeral 2 indicates a cantilever, the numeral 3 indicates a bar or pipe made of soft iron, or an electric conductive piece made of small magnet, the numeral 4 indicates a rubber ring positioning the center of the cantilever 2 and the numeral 5 indicates a metallic sleeve for maintaining the tip 1, the cantilever 2, the bar, pipe or the electric conductive piece 3 and the rubber ring 4 therein. A stylus or needle assembly is composed of the tip 1, the cantilever 2, the piece 3, the rubber ring 4 and the sleeve 5. The reference numeral 6 indicates a coil or coil portion, the numeral 7 indicates a fore magnetic pole or one yoke and the metallic sleeve 5 is inserted to be removable in a small aperture 8 of the yoke 7. The reference numeral 9 indicates a back magnetic pole or another yoke and the coil 6 is provided at the end of the yoke 9 and a slight gap is opposedly provided between the coil 6 and the electric conductive piece 3. The reference numeral 10 indicates a magnet located between both yokes 7 and 9 and a magnetic circuit is formed by a magnetic force from the magnet 10 to the yoke 9 through the yoke 7, the electric conductive piece 3 and the coil 6.

Figure 2:
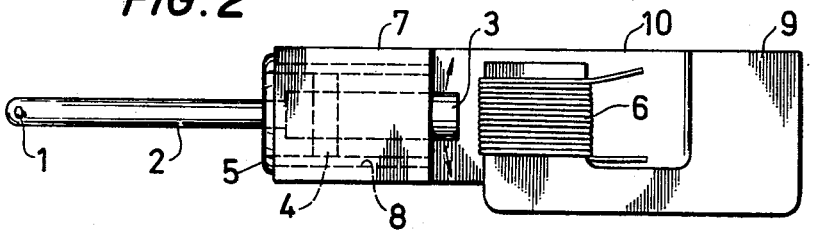
FIG. 2 is a bottom view of the first embodiment.

With the structure above, referring to FIG. 2, when the tip 1 is progressively moved along the sound groove of record, the conductive piece 3 is slightly moved as shown in the arrow direction and the magnetic flux of the piece 3 is moved to the perpendicular direction to the spiral direction of coil 6 even though the total amount of magnetic flux is constant. Thus, an electric current in coil 6 is generated to the perpendicular direction to the paper of FIG. 2, which is proportional to the movement of magnetic flux. Therefore, if the movement of the conductive piece 3 is carried out along the wave form of sound, the electric current generated in coil 6 is the same to the wave form of sound, so the user can be rerecorded extremely exact original sound from the record without occurrences of any deformations or deflections because of the dynamic electricity type.

And, according to this invention, the coil or coil portion 6 has been fixed to the end of the yoke 9, the user has an advantage in which there is no necessity of care about the treatment of outgoing line, and this invention has a further advantage comparing to the prior moving coil type which needs to exchange together with the coil for the power generation, namely when the tip 1 of the movable portion in this invention which acts to transmit or trunk the magnetic force through the bar or, pipe made of light soft iron to the direction to be circuited, has been worn, the movable portion only can be effectively exchanged to a new one.

Figure 3:
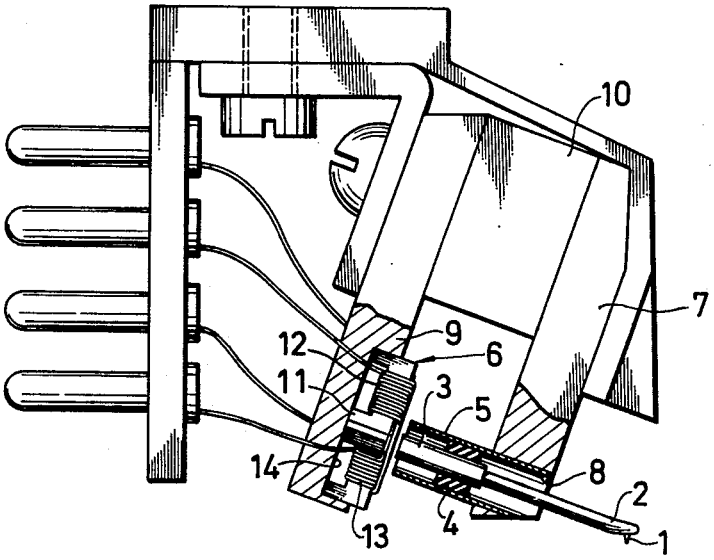
FIG. 3 is a side view of the second embodiment with parts partially broken away.
Figure 4:
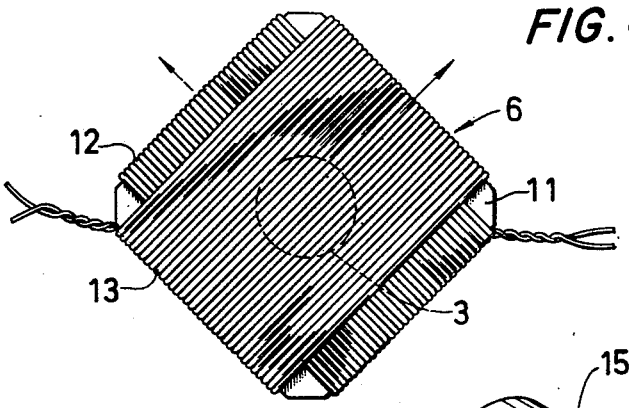
FIG. 4 is a partially enlarged view thereof for clarification.

The second embodiment of this invention applied to a stereo pickup type with reference to FIGS. 3 and 4 is described below.

In this embodiment, the coil or coil portion 6 is formed on a substantially rectangular coil frame 11 having legs, said coil portion 6 being made to spiral in cross shape by a use of each coil 12 13 at a right angle to each other and is inserted in a recess 14 of the yoke 9 located in the inclination of 45° to the horizontal plane. The same references in FIGS. 3 and 4 of this embodiment to FIGS. 1 and 2 indicate the same portions, so the description thereof is omitted.

With the structure above, the following advantage can be, expected, namely when the magnetic force generated basing on the movement of tip 1 is provided the power generation to the coil 12 by crossing the magnetic force at a right angle, it will be appreciated that there is no occurrence of power generation in other coil 13 because the magnetic force of coil 12 moves in parallel with that of other coil 13 thereby to avoid the occurrence of cross-stroke based on left and right channels and in addition to, the ratio of S/N can be maintained in a relatively large ratio because the coil portion of this embodiment receives less affection from the outside magnetic field.

Figure 5:
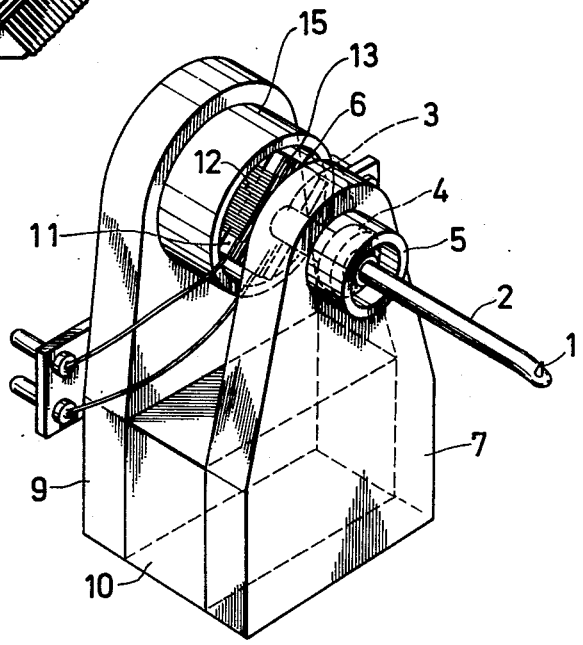
FIG. 5 is a perspective view of the third emdodiment.
Figure 6:
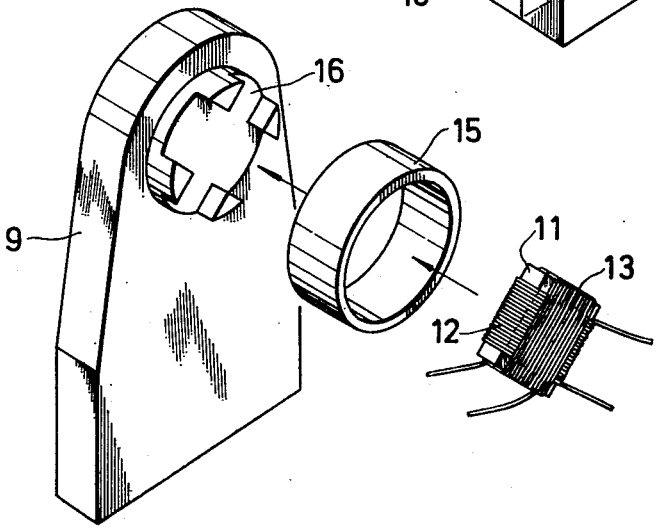
FIG. 6 is a partially exploded view thereof.

The third embodiment of this invention applied to a stereo pick up type with reference to FIGS. 5 and 6 is described below.

In this embodiment, the coil portion 6 is removably fixed to a fitting portion 16 of the yoke 9 through a magnetic shield 15 inserted at the grooved periphery of said fitting portion 16, and each groove of the fitting portion 16 like legs of the coil frame 11 as shown in the second embodiment acts to avoid a difficulty of fitting of coil portion 6 to the yoke 9 and an occurrence of disarranged fitting in conformity with the height of laminated coil layer of coil spiraled to the coil frame 11.

FIG. 6 shows an opposing condition of the electric conductive piece 3 to the coil portion 6 and when said conductive piece 3 is vibrated in this condition to the solid line direction, the phenomenon of power generation occurs because the coil 12 cuts the magnetic flux, on the contrary, since the magnetic flux moves in parallel with the coil 13 to not cut said magnetic flux, the phenomenon of power generation does not occur. And, when the electric conductive piece 3 moves to the dotted line direction, it will be appreciated that a complete stereo rerecording can be accomplished by the phenomenon of generation basing on the coil 13 and no generation basing on the coil 12.

In addition to, in case where the electric conductive piece 3 is made of magnet, it will be also appreciated that the material of the magnet 10 can be substituted for a magnetic conductive material without magnet itself.

If is to be understood that the form of this invention herein shown and described is to be taken as preferred examples of the same and that various changes in the shape, size and arrangement of parts may be resorted to without departing from the spirit of this invention or the scope of the accompanying claims.

What is claimed:

1. A record pick-up, comprising a pole piece having spaced magnetic leg portions, a coil wound around one of said leg portions, the other of said leg portions having a bore therethrough extending in a direction away from said coil, a resilient annular member disposed in said bore, a pick-up needle assembly including a needle holder having a needle, adjacent one end of said holder, which is adapted to engage in a record groove and a conductor piece, carried at the opposite end of said holder, having an opposite end face disposed adjacent said coil, said annular member resiliently supporting said conductor piece in said bore, said conductor piece being movable upon movement of the needle in the groove of a record to vary the magnetic field around said coil and introduce an acoustic current flow therein.

2. A record pickup, comprising a magnetic yoke having spaced apart first and second leg portions, said first leg portion having an upstanding portion with a coil disposed therearound, said second leg portion being opposite to said coil and having a bore therethrough extending from the side of said second leg portion adjacent said coil in an opposite direction to the opposite side of said second leg portion, a pickup needle holder comprising a cylindrical electric conductor piece having an end face disposed opposite the coil and extending through the bore of said second leg portion, a metallic sleeve disposed in and lining the complete length of the bore of said second leg portion around said cylindrical conductor piece, a resilient ring disposed between said sleeve and said cylindrical conductor piece and resiliently supporting said conductor piece in the bore, said pickup needle holder including a stylus bar extending outwardly from said cylindrical conductor piece in a direction away from the coil terminating in a record groove engaging needle, the end of said conductor piece adjacent said coil being disposed in the field of said coil and permitting vibration of said needle when the needle engages in a record groove and also permitting the corresponding vibration of said conductor piece to provide an acoustic current in said coil which varies with the movement of said needle.

3. A record pick-up according to claim 2, wherein said first leg portion includes a side face with a fitting portion with spaced legs having arcuate exterior surfaces forming a partial cylindrical support, said electric coil comprising a flat member having a coil means thereon with separate winding axes disposed at angles to each other and positioned between said support members, a cylindrical shield extending over said support members and said electric coil.

* * * * *